United States Patent [19]

Smith

[11] Patent Number: 4,961,714

[45] Date of Patent: Oct. 9, 1990

[54] MOUNTING ARRANGEMENT FOR A MARINE RADIO DISTRESS BEACON

[76] Inventor: David A. Smith, 31 Eastry Ave., Haynes, Bromley, Kent, England

[21] Appl. No.: 363,986

[22] Filed: Jun. 9, 1989

[51] Int. Cl.[5] ..... B63C 9/22

[52] U.S. Cl. ..... 441/10; 441/11; 441/32

[58] Field of Search ..... 441/6, 7, 9–11, 441/21, 32, 33; 114/378, 379, 367, 376; 116/210

[56] References Cited

U.S. PATENT DOCUMENTS 3,893,202 7/1975 Higgs et al. ..... 441/7
4,433,638 2/1984 Ashline ..... 441/7 X
4,784,626 11/1988 DeLaro ..... 441/7

FOREIGN PATENT DOCUMENTS 2085812 5/1982 United Kingdom ..... 441/10

*Primary Examiner*—Joseph F. Peters, Jr.
*Assistant Examiner*—Edwin L. Swinehart
*Attorney, Agent, or Firm*—Wenderoth, Lind & Ponack

[57] ABSTRACT

An arrangement for mounting a radio distress beacon (1) comprises a split casing (4) which is bouyant and which is normally held together and to the deck of a vessel by a harness (7). If the vessel should sink the harness is released, the casing rises to the water surface and springs (20) overcome the hydrostatic pressure at shallow depths and force the halves of the casing apart, so releasing the beacon.

6 Claims, 2 Drawing Sheets

MOUNTING ARRANGEMENT FOR A MARINE RADIO DISTRESS BEACON

The invention relates to marine radio distress beacons for location of survivors in the event of an accident at sea. It is a requirement that such beacons should be capable of automatic deployment in the event of the sinking of a vessel on which they are carried. Thus, each beacon should be capable of floating and be stowed in a position where it may float free when released. An automatic release mechanism must be provided, possibly a pressure-sensitive device which releases on submersion to a given depth. The invention seeks to provide an improved deployment system for such a beacon.

According to the invention there is provided a mounting arrangement for a marine radio distress beacon comprising a hollow water-tight protective casing which accommodates the beacon, the casing including the beacon being appreciably bouyant in water and being composed of at least two separable parts and automatic release means effective to separate the parts and release the radio distress beacon when the casing rises to a water surface after being submerged therein.

The casing parts may be weighted so that they sink to release the beacon when the casing opens. Preferably there are two parts but there may be more. The release means may be springs or the like which urge the casing parts apart at the surface but which are not strong enough to overcome the pressure of water at significant depth. Thus, until the casing is at least near the surface it remains closed so that its buoyancy is used to drive the assembly to the surface and it continues to protect the beacon on the way up.

Preferably the casing is mounted on the deck of the vessel by means of deck fittings including a harness which binds the casing to the deck and holds the casing closed. With this arrangement there is provided a mounting system which not only holds the casing to the vessel under normal circumstances but also holds the parts of the casing together against the force of the springs.

Another release arrangement envisaged is the provision of a compressed air cylinder with a valve which when released pressurises the inside of the casing, the valve being held off by the mounting arrangement of the casing to the vessel and by a water-pressure sensor, so that release is possible only when the casing is (a) free of the vessel and (b) near or at the surface.

The invention will further be described with reference to the accompanying drawings, of which:

Figure 1:
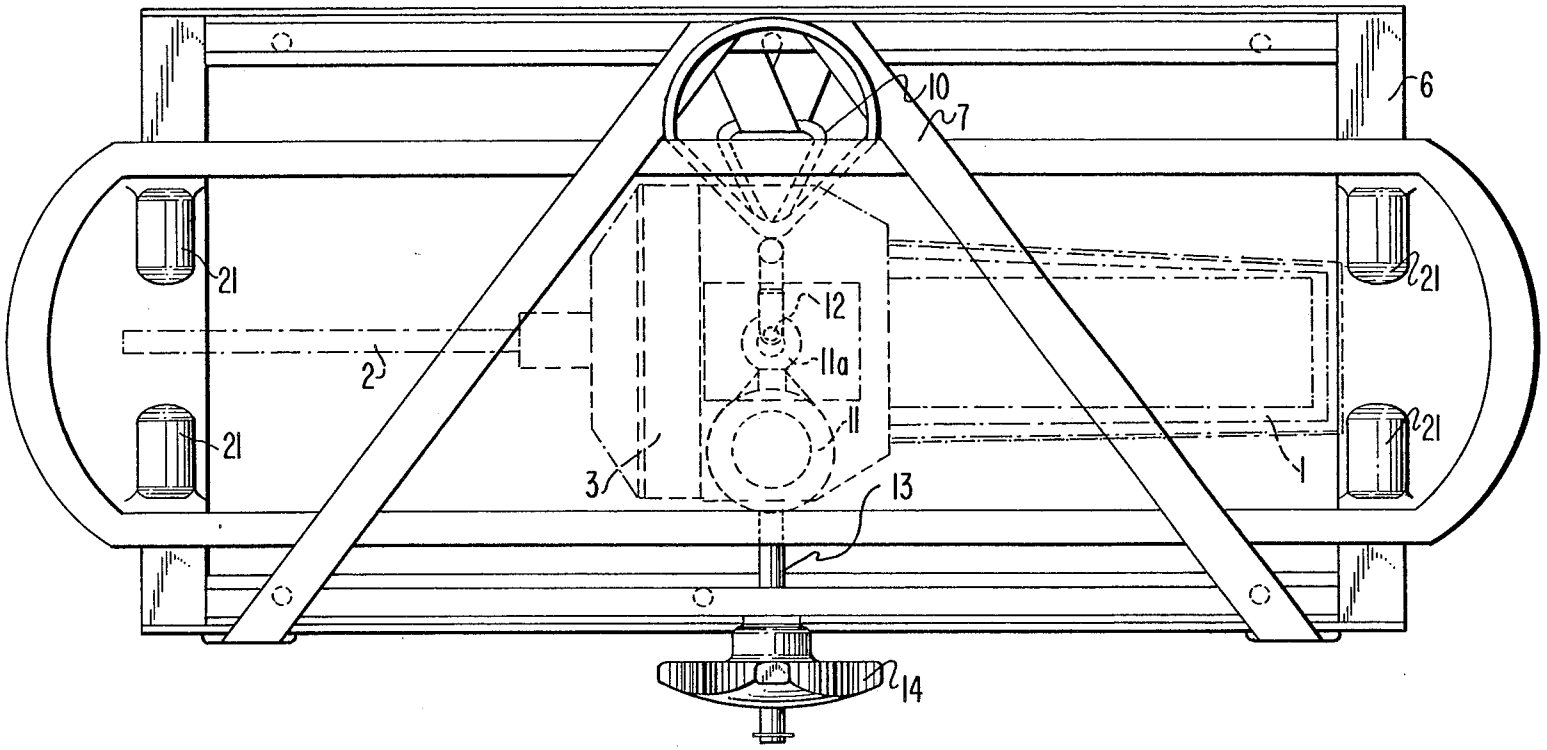
FIG. 1 is a plan view of a mounting arrangement for a marine distress radio beacon embodying the invention.
Figure 2:
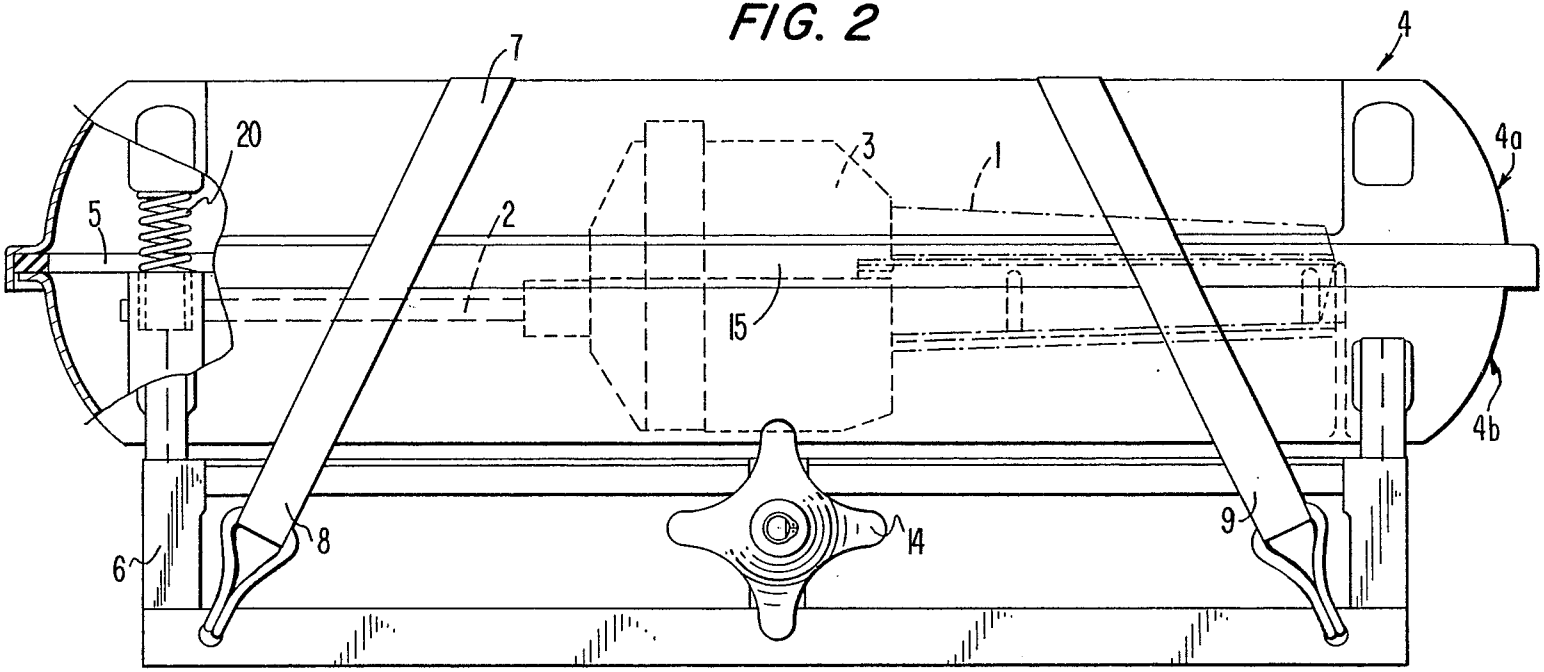
FIG. 2 is a side elevation, partly sectioned, of the arrangement of FIG. 1.

Referring to FIGS. 1 and 2 the radio beacon is shown at 1, having an antenna 2 and a flotation collar 3. In water the beacon floats upright and is automatically activated to send distress signals.

The beacon is housed in a cylindrical casing 4, typically of glass-fibre having an upper half 4*a* and a lower half 4*b*. A sealing gasket 5 at the junction of the two halves ensures that the casing is sealed. In use, the casing is mounted by means of deck fittings which comprise a cradle 6 which is fixed to the deck or a bulk-head of a vessel. A harness is constituted by a retaining strap 7 which is fixed to the cradle at its ends 8 and 9, passes over the upper half of the casing and through a harness link 10. Link 10 is attached to a pressure release unit 11*a* via a shackle 11 with a manual release pin 12. The shackle 11 is attached to a threaded rod 13 which passes through the cradle and is retained by a hand-wheel 14. Turning the hand-wheel tightens or slackens the harness.

Figure 3:
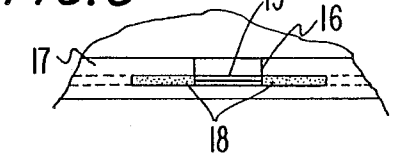
FIG. 3 is a drawing of detail showing means for indicating correct holding tension for the retaining harness.

It will be seen that the harness not only holds the casing to the vessel but also holds the two halves of the casing together. Tightening the harness compresses the sealing gasket 5 and at 15 there is an indicator arrangement which is shown in detail in FIG. 3. This comprises a cut-away portion 16 of the overhanging lip 17 of the upper half of the casing and indicator lines 18, printed on the lip. When the seal is appropriately compressed the lines 18 align with the rim 19 of the lower half of the casing seen through cut-out 16. The hand-wheel is adjusted accordingly.

An important feature of the assembly is the provision of four coil springs 20 at positions 21. The springs are bonded in the lower half of the casing and free with respect to the upper half. These are such as to urge the two halves of the casing apart when the harness is released unless the casing is more than a few feet—perhaps 2 or 3 feet—below the surface of the water, when water pressure will hold it closed.

If the vessel should sink the pressure release unit operates to release the casing which floats to the surface by virtue of its appreciable buoyancy. The beacon is thus efficiently brought to the surface and is protected on the way up. At the surface the springs 20 open the casing to allow water in. The beacon floats free and the two halves of the casing sink, being weighted to do so. The two halves of the casing may be tied together at one point so that they sink together.

The beacon may be accessed manually by with-drawing the manual release pin 12 and opening the casing on deck.

I claim:

1. A mounting arrangement for a marine radio distress beacon comprising a hollow water-tight protective casing which accommodates the beacon, the casing including the beacon being appreciably bouyant in water and being composed of at least two separable parts and automatic release means effective to separate the parts and release the radio distress beacon when the casing rises to a water surface after being submerged therein.

2. A mounting arrangement for a marine radio distress beacon as claimed in claim 1 wherein the automatic release means comprises springs held under compression and acting to urge the separate parts apart, the force of the springs being insufficient to overcome hydrostatic pressure on the casing at water depths of more than a few feet but sufficient to separate the parts at the water surface.

3. A mounting arrangement for a marine radio distress beacon as claimed in either of the preceding claims wherein the parts of the casing are weighted so that they are not independently bouyant when separated.

4. A mounting arrangement for a marine radio distress beacon as claimed in claim 1 in combination with deck fittings for mounting the casing on the deck of a vessel, the deck fittings including a harness which binds the casing to the deck of the vessel and holds the casing closed.

5. A mounting arrangement for a marine radio distress beacon as claimed in claim 4 wherein there is provided an automatic pressure release unit which releases the harness when subjected to a predetermined hydrostatic pressure.

6. A mounting arrangement for a marine radio distress beacon as claimed in claim 4 wherein the casing has two halves and a compressible gasket therebetween and the deck fittings include a tension adjusting handwheel for the harness, there being further a visual indicator for indicating the extent of the gasket compression.

* * * * *